US006289684B1

(12) United States Patent
Guidry, II et al.

(10) Patent No.: US 6,289,684 B1
(45) Date of Patent: Sep. 18, 2001

(54) TRANSPORTABLE, SELF-CONTAINED, REFRIGERATION SYSTEM

(76) Inventors: John L. Guidry, II, 169 E. 51st St., Cut Off, LA (US) 70345; Kevin L. Morales, 115 Timbalier Dr., Houma, LA (US) 70363

( * ) Notice: Subject to any disclaimer, the term of this patent is extended or adjusted under 35 U.S.C. 154(b) by 0 days.

(21) Appl. No.: 09/483,088

(22) Filed: Jan. 14, 2000

(51) Int. Cl.[7] ..... F25B 49/00
(52) U.S. Cl. ..... 62/229; 62/239
(58) Field of Search ..... 62/229, 239, 371

(56) References Cited

U.S. PATENT DOCUMENTS 5,337,579 * 8/1994 Saia, III et al. ..... 62/239
5,343,712 * 9/1994 Gowan ..... 62/229
5,557,941 * 9/1996 Hanson et al. ..... 62/229
5,586,438 * 12/1996 Fahy ..... 62/371
5,966,956 * 10/1999 Morris et al. ..... 62/371

* cited by examiner

*Primary Examiner*—William E. Tapolcai
*Assistant Examiner*—Mohammad M. Ali

(74) *Attorney, Agent, or Firm*—Pugin/Associates Patent & Trademark Attys; C. Emmett Pugh

(57) ABSTRACT

An extended, box-like, metal, industrial size, insulated container (1/101, two embodiments disclosed, FIGS. 1–1G & FIGS. 2A–2D) including a rigid, structural framework (12/13) for safely and reliably transporting and/or storing relatively large quantities of temperature sensitive items (food, medical supplies, ice, human corpses, etc.) over a long distance (e.g., from an on-shore food center to an offshore platform) and/or for a substantial period of time (7+days), useful for such delivery/storage and in emergencies, disasters, etc. The container includes at its ends a structurally protected, enclosed equipment section (2/102), which includes all operating machinery (e.g. compressor, motor, fuel tank, control mechanisms, etc., in isolated sub-compartments) and associated equipment, and a freezer/cooler section (3/103A–103B) for the temperature sensitive items. The second embodiment includes two, separate, freezer and cooler sections (103A/103B) with separate, side doors (105A/105B). An escape structure (FIGS. 3A & 3B) on the lock latch is included on the access door(s) for escape of an occupant who becomes locked in. Many other, innovative safety features are disclosed, along with innovative use methodologies (FIGS. 4 & 5).

22 Claims, 7 Drawing Sheets

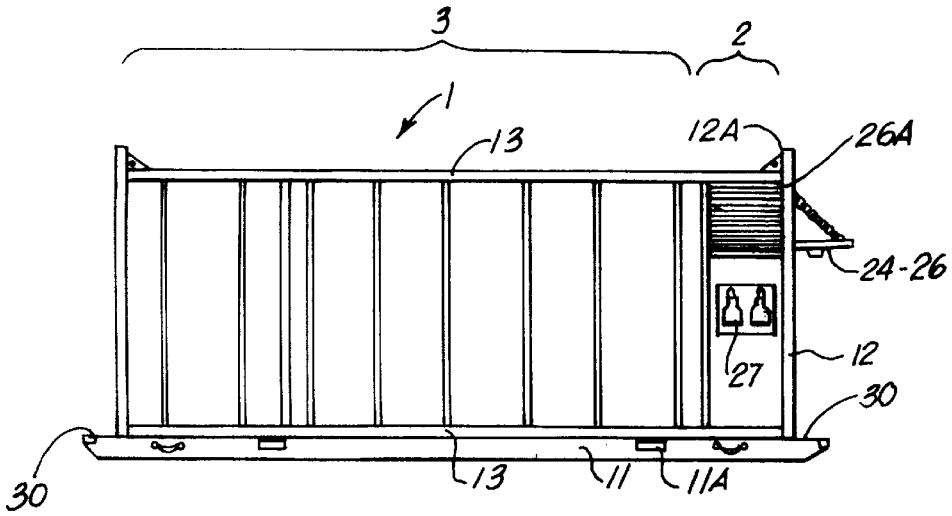
FIG. 1A
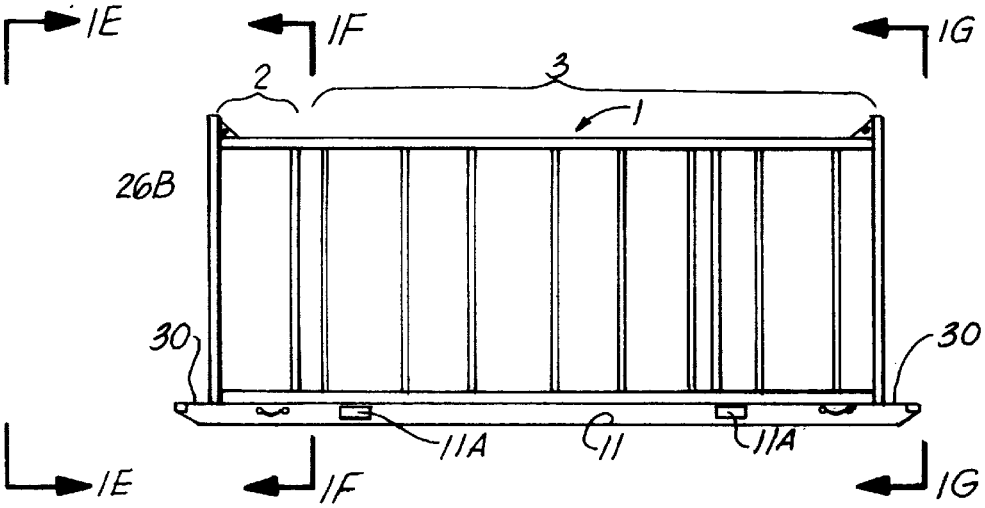
FIG. 1B
FIG. 1F
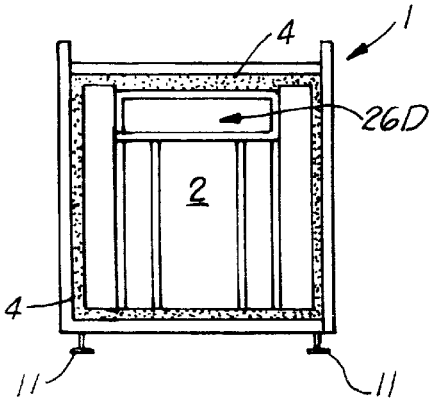
FIG. 1G
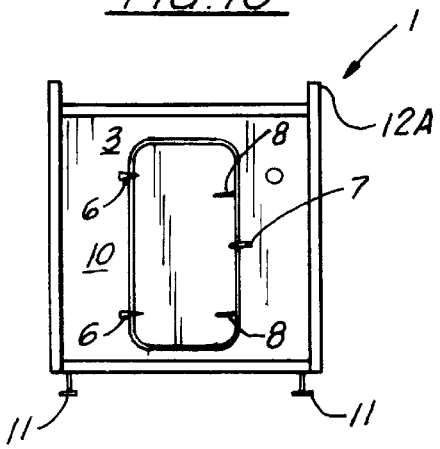

Fig. 4

1. Select the appropriate container(s) 1 for the delivery.

2. Load the needed temperature sensitive items into the refrigerated storage compartment.

3. In association with step 2, start the diesel motor driving the compressor 14 to cool down the interior of the storage compartment and any temperature sensitive items therein to the desired set temperature level.

4. After the loading is complete, close and lock the access door(s) 5 and make any final settings at the control panel 18.

5. Transport the loaded, cooled container(s) 1 to the destination site over land, and, if necessary, over water, while preferably substantially maintaining the access door(s) 5 closed while the loaded container(s) is/are being transported, while using the protective features (*e.g.*, .containment of the equipment within a structurally strong beam framework and walled enclosure, using the extended skids 11 to protect the end wall of the equipment section and any alarm light 28, *etc.*) of the container(s) 1 to protect the equipment in the enclosed equipment section 2 and the safety features (*e.g.*, waste & fuel tanks 16 & 17, compressor-motor 14 and electrical components 18 in three, physically isolated sub-compartments 21A, 26C & 22A, respectively, waste oil collection, fire extinguisher, spark arresters, emergency engine shut-down, engine over-speed preventer, alarm light 28, *etc.*) to safely transport the temperature sensitive items in the container(s). Also, use, if necessary or desired, electrical power along the way and at the destination site to alternatively drive the refrigeration compressor.

6. At the destination site, unlock the door(s) 5 when access is needed and remove any needed items.

7. Additionally, if so desired, use the still, at least partially loaded container(s) 1 for longer term storage using power derived from the destination site.

8. Ultimately return the now substantially empty container(s) 1 to the originating site.

Fig. 5

1. Select the appropriate container(s) 1 for transporting to the disaster/emergency site.

2. Load the needed temperature sensitive items into the refrigerated storage compartment(s), or, alternatively, transport the container(s) empty. If needed, send two or more containers 1 on a flat-bed trailer truck, with, for example, three twelve (12') foot containers being placeable end-to-end on an eighteen wheeler. If temperature sensitive items have been loaded, start diesel motor driving the compressor 14 to cool down the interior of the storage compartment(s) and any temperature sensitive items therein to the desired set temperature level and close and lock the access door(s) 5 and make any final settings at the control panel 18.

3. Transport the container(s) 1 to the destination site over land, and, if necessary, over water, while preferably substantially maintaining the access door(s) 5 closed while the container(s) is/are being transported, while using the protective features (*e.g.*, .containment of the equipment within a structurally strong beam framework and walled enclosure, using the extended skids 11 to protect the end wall of the equipment section and any alarm light 28, etc.) of the container(s) 1 to protect the equipment in the enclosed equipment section 2 and the safety features (*e.g.*, waste & fuel tanks 16 & 17, compressor-motor 14 and electrical components 18 in three, physically isolated sub-compartments 21A, 26C & 22A, respectively, waste oil collection, fire extinguisher, spark arresters, emergency engine shut-down, engine over-speed preventer, alarm light 28, *etc.*) to safely transport the container(s). Also, use, if necessary or desired, electrical power along the way and/or at the destination site to alternatively drive the refrigeration compressor.

4. At the destination site, winch the container(s) 1 off of the truck bed on its/their skids 11 and unlock any locked door(s) 5 when access is needed, and remove any needed items that have been loaded. Use the skids 11 and the fork tine slots 11A to easily move the container(s) 1 around the site as needed.

5. Additionally, if so desired, use any still, at least partially loaded container(s) 1 for longer term storage using power derived from the destination site, if available. Use the container(s) on site for refrigerated storage of items that were not originally transported in the container(s), for example, ice, human corpses, *etc.* Ultimately return the container(s) 1 to the originating site.

TRANSPORTABLE, SELF-CONTAINED, REFRIGERATION SYSTEM

TECHNICAL FIELD

The present invention relates to a refrigeration system which includes a refrigerated, industrial size container which is self-contained and easily transported from one location to another and easily moveable on and off, for example, a trailer truck, as well as to associated methodology for using the transportable, self-contained, refrigerated container to deliver food or other temperature sensitive materials to, for example, offshore platforms or for use in emergencies and disasters, war zones, including, for example, hurricanes, earthquakes, tornadoes, floods, "war" zones, and the like, etc. Additionally, the present invention is directed to a door latch lock that can be disengaged from the inside for use, for example, when someone is locked into the refrigerated compartment of the container, allowing the occupant(s) to get out of the container. The container forms a rigid, strong, protective enclosure, in which all of the working equipment [refrigeration compressor, motor(s), fuel tank, control panel, etc.], are compactly, protectively housed at one end of the container] completely behind closed walls, with the tank being isolated from the electrical components.

BACKGROUND ART

Large, industrial size, metal containers have been around for many years and have been long used in transporting goods, an example being those used on container vessels or trailer trucks. Likewise, refrigerated compartments incorporated into, for example, truck trailers, and the like, have also been around for long periods of time in the field of transportation.

However, until the present invention, no one has, it is believed, provided an easily transportable and easily moveable, self-contained, refrigerated container, particularly one having the innovative features of the present invention, which features allow, for example, the use of the container in the way used with respect to the methodologies of the present invention, as part of the system of the present invention. Additionally, with respect to the container itself, prior art systems expose at least substantial parts of its operating equipment to damage by merely hanging the equipment off of the sides of the container body and failing to isolate the fuel supply from electrical components, which can cause the fuel to be ignited by electrical sparks. Many other innovative structural features and add-ons are provided in the present invention.

Exemplary methodologies of the "prior art," the problems of which the present invention solves, include the following.

Distribution of Food to Oil Platforms

At present, in the "prior art," frozen food products are packaged into boxes and packed with dry ice. The iced boxes are then loaded into a refrigerated truck and delivered to the designated port. At the dock the boxes are loaded into a non-refrigerated metal box or container where it often will sit for approximately two to twenty-four (2–24) hours, waiting for a supply vessel to arrive and then to be loaded on the supply vessel.

After it's placed on the vessel it may be another approximately two to twenty-four (2–24) hours before actually reaching the designated offshore platform. Additionally, oil companies currently are drilling in deeper and deeper waters now which are further and further offshore, adding to the dock-to-platform delivery time.

When the vessel finally reaches the platform, the boxes are taken out of the unrefrigerated metal box and placed into the platform's freezer.

As time goes on during this process, the thermal properties of the dry ice begin to break down, resulting in adverse changes in rising food temperatures. The federal agency OSHA has a number of reported cases of food poisoning related to this problem. Also, when the food delivery is delayed for a long period of time, such as currently occurs relatively often, it has to be and is thrown away, resulting in substantial financial loss and deprivation to the platform personnel with respect to what is available to them for eating.

Additionally and coincidentally, one of the co-inventors hereof happened just recently to observe a grocery order being delivered in cardboard boxes packed in dry ice, loaded on a pallet, and left there all day in the sun next to oil drums to await transportation to an offshore rig. The packed food was still there well into the night and possibly much longer. Such long-term, direct exposure to the sun, particularly in the hot environs of south Louisiana, from which most offshore platforms are supplied, clearly creates a great risk of food spoilage.

In addition to food stuffs, the temperature protection of medical supplies while they are being shipped or stored is very important.

The system of the present invention solves these long-standing, great-need, problems of the prior art.

"FEMA" Type Emergency/Disaster Operations

When, for example, a disaster strikes, such as, for example, in the after-effects caused by hurricanes, earthquakes, tornadoes, floods, and the like, the only means of containing cold products in the "prior art" typically has been with a generator pack. This requires having to run the generator twenty-four (24) hours a day burning fuel. Additionally, such generator packs are very limited in their use, even though they are significantly expensive.

Bombed out areas and war zones provide other examples of "emergency" type situations in which the system of the present invention is applicable. The foregoing examples are, of course, not exhaustive of such applications, with many more known to those of ordinary skill.

The system of the present invention also solves these long-standing, great-need, problems of the prior art.

General Summary Discussion of Invention

As noted above, the present invention is directed to a refrigeration system which includes, in its preferred embodiments, a refrigerated, industrial size container which is self-contained and easily transported from one location to another and easily moveable on and off, for example, a trailer truck. The present invention is also diected, as well, to associated methodology for using the transportable, self-contained, refrigerated container to deliver relatively large quantities of food or other temperature sensitive materials or items to, for example, offshore platforms, or for use in emergencies and disasters, including, for example, hurricanes, earthquakes, tornadoes, floods, bombed out zones, war zones, and the like, etc.

Additionally, the present invention is directed to a door latch lock that can be disengaged from the inside for use, for example, when someone is locked into the refrigerated compartment of the container, allowing the occupant(s) to get out of the container.

The preferred, exemplary embodiments of the invention are each directed to an extended, box-like, metal, industrial size, insulated container including a rigid, structural framework for safely and reliably transporting and/or storing relatively large quantities of temperature sensitive items (food, medical supplies, ice, human corpses, etc.) over a long distance (e.g., from an on-shore food distribution center to an offshore platform a substantial distance off-shore) and/or for a substantial period of time (about, for example, 7+days), useful for such delivery/storage to such a far removed site, and for on-site use in emergencies, disasters, etc. The container includes at its ends a structurally protected, enclosed equipment section, which includes all operating machinery (e.g. compressor, motor, fuel tank, control mechanisms, etc., in isolated sub-compartments) and associated equipment, and a freezer/cooler section for the temperature sensitive items.

The second embodiment includes two, separate, freezer and cooler sections with separate, side doors. An escape structure on the lock latch is included on the access door(s) for escape of an occupant who becomes locked in. Many other, innovative safety features are disclosed and discussed below, along with innovative use methodologies are also discussed in detail below.

The container forms a rigid, strong, protective enclosure, in which all of the working equipment [refrigeration compressor, motor(s), fuel tank, control panel, etc.], are compactly, protectively housed at one end of the container, completely behind closed walls, with the fuel tank and other equipment which can produce or have in proximity combustible fumes, being isolated from the electrical components which could produce a spark and hence ignition of the fumes or fuel.

Additionally, the objects and the other innovative aspects of the present invention are disclosed below and/or will be understood by those of ordinary skill.

BRIEF DESCRIPTION OF DRAWINGS

For a further understanding of the nature and objects of the present invention, reference should be had to the following description, taken in conjunction with the accompanying drawings, wherein:

FIGS. 1A & 1B are right and left, side views, respectively, of the container of FIG. 1, with the contents of the two figures of the two sides being substantially the same.

FIGS. 1E, 1F & 1G are "end" views, initially of the equipment end showing the exterior at that end (FIG. 1E), and then the near interior end adjacent to and looking toward the equipment section (FIG. 1F), with FIG. 1F taken at the location of section lines 1F—1F of FIG. 1B, and then the door end (FIG. 1G), respectively, of the container of FIG. 1, with perspective lines 1E and 1G showing the respective directions of the views in FIG. 1B.

FIG. 4 is a flow chart showing the preferred, exemplary steps used in the "offshore platform food delivery" methodology as part of the transportable, self-contained, refrigeration system of the present invention, using the container of, for example, FIGS. 1 & 1A+; while FIG. 5 is a flow chart showing the preferred, exemplary steps used in the "emergency/disaster" methodology as part of the transportable, self-contained, refrigeration system of the present invention, using the container of, for example, FIGS. 1 & 1A+

EXEMPLARY MODES FOR CARRYING OUT THE INVENTION

Figure 1:
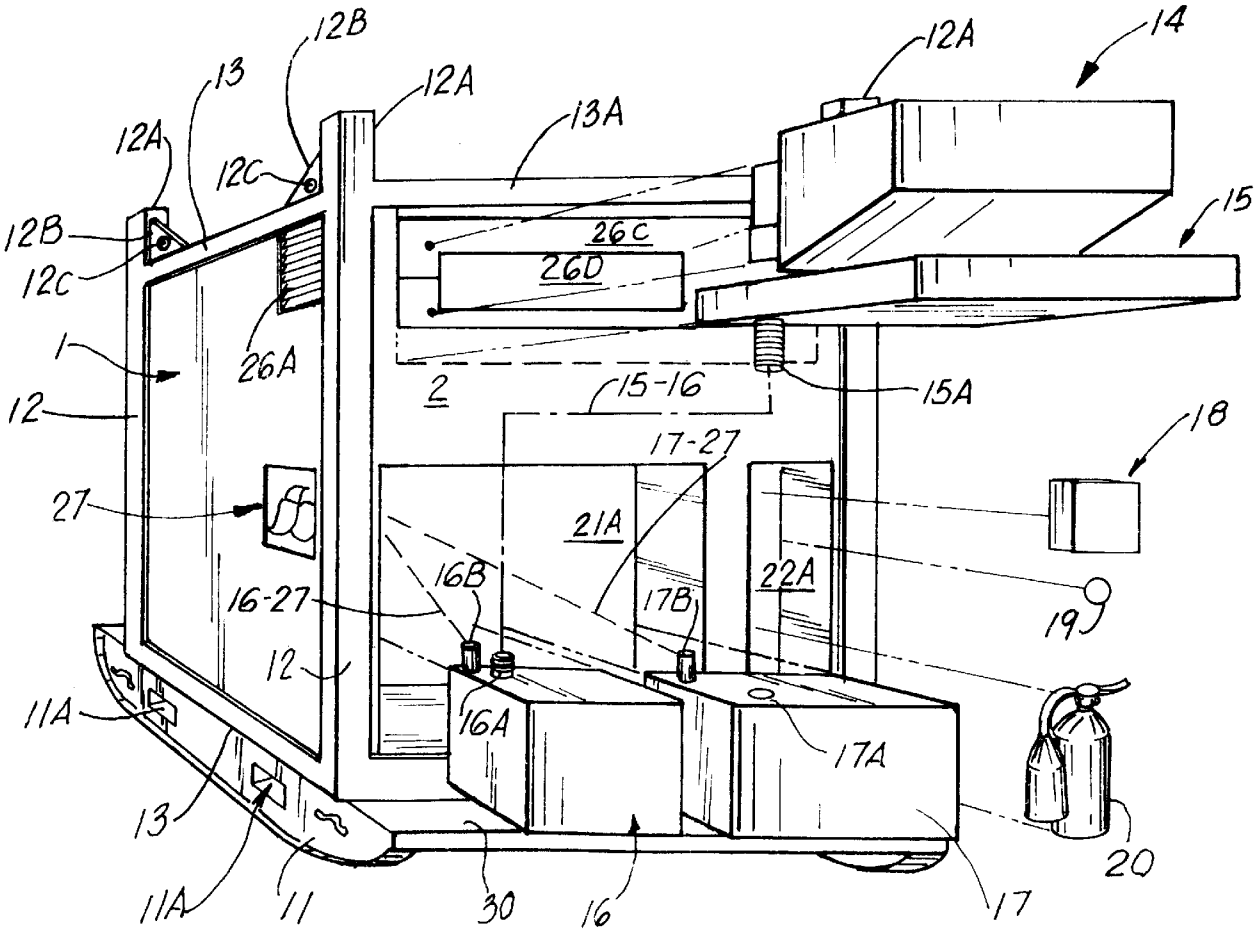
FIG. 1 is an exploded, perspective view of the equipment end of a first, preferred, exemplary embodiment of the container of the transportable, self-contained refrigeration system of the present invention.

As can be seen in FIGS. 1 and 1A+, the first embodiment of the currently preferred, exemplary embodiment of the transportable, self-contained, refrigeration system of the present invention includes a strong, rigid, industrial size container 1 forming a rectangular, extended box like structure. The container 1 has basically two main sections—an equipment end section 2 and a larger, lowered-temperature-maintained, storage compartment section 3 for holding foods, medicines and other temperature sensitive, perishable items.

The storage section 3 includes insulation 4 along all of its interior (note particularly FIGS. 1D & 1F) forming an enclosed, sealed insulation compartment. The insulation can be, for example, a four (4") inch thick layer of polyurethane foam lined with aluminum or stainless steel. A metal door 5 is provided at the exterior end of the compartment section 3 (note FIGS. 1C, 1D & 1G). As can be seen in FIG. 1G, the door 5 is mounted on side hinges 6 and is latch-locked with a latch 7, which is locked by a padlock 7A (note FIG. 3B) supplemented by rotatable latch handles 8 in similar fashion to bulkhead door on marine vessels. The door, of course, is used for easy access to the interior of the storage compartment 3 and typically would be provided with a pad lock for security purposes.

Figure 3B:
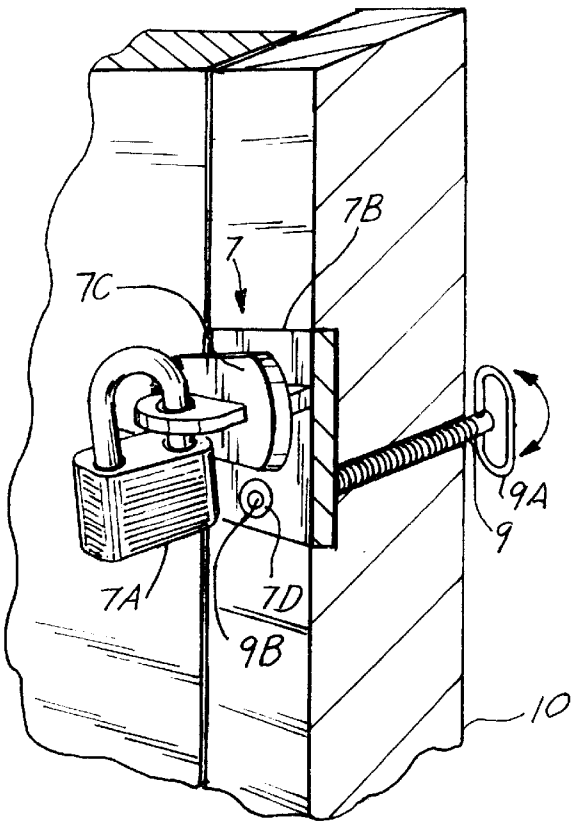
FIGS. 3A & 3B are detail view of the safety, escape lock feature for the doors of the two embodiments of the containers of FIGS. 1A+ and 2A+.
Figure 3A:
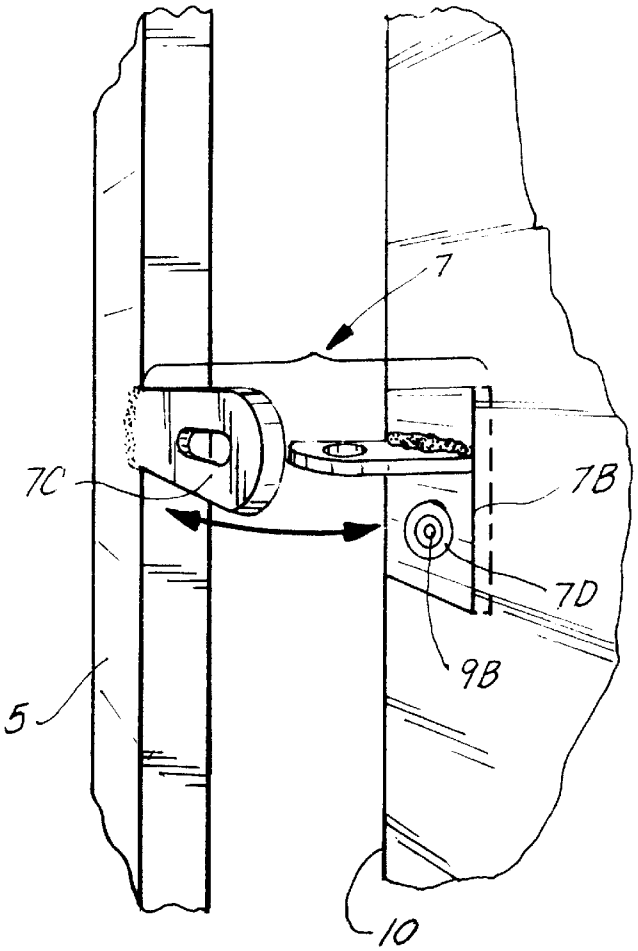

The padlock latch 7 preferably includes safety, escape means to allow an occupant or worker to get out of the cooled or frozen storage compartment 3, should the occupant or worker inadvertently or otherwise get pad-locked in. As can be seen in FIGS. 3A & 3B, the preferred, exemplary embodiment of the safety escape structure of the present invention includes a threaded rod 9, which holds the latch plate 7B to the exterior of the compartment wall 10.

As is well known, the pad lock 7A locks the door latch 7C to the latch plate 7B, locking the door 5 closed, securing the contents of the storage compartment 3 from pilferage. When it is necessary to escape out of the locked and latched storage compartment, the occupant/worker merely twists the threaded rod 9 (note curved direction arrow) in the appropriate, counter-clockwise, unscrewing direction using the handle 9A, which causes the distal tip .9B of the rod to come out of its threaded engagement with the like threaded plate connector 7D. This in turn causes the latch plate 7B to become disengaged from the wall 10, allowing the door with the still padlocked latch structure 7B/7C/7D, to swing out, allowing the occupant/worker to escape. It is noted that the supplemental, rotatable latches 8 (FIG. 1G) can be disengaged from the inside and do not impede an escape.

The four corners of the container 1 are formed of four, structurally strong, girder or box beams 12 (note FIG. 1+), a section 12A of each of which extend above the basic, longitudinally extended, box configuration of the unit 1. The base of the unit 1 includes a pair of parallel, spaced, structurally strong, side skids 11 (note FIGS. 1, 1A & 1B) that allow multiple ones of the units to be stacked mounted, one on top of the other, with the skids fitting between the sides of the corner extensions 12A, securing them together and preventing an upper one from moving off to the side of a lower one. The skids 11, mounted on the bottom of the enclosed container 1, preferably do extend beyond the ends of the container (note FIGS. 1, 1A & 1B), providing some protection to the end walls of the container and a footing, step area 30 (FIG. 1) of a size sufficient for a person to stand on.

To meet offshore requirements, sling connector, corner plates 12B (note FIG. 1) with sling connector holes 12C are welding to the basic structural beam members 12 & 13, that is, to the vertical corner and top side beams, respectively, of the box structure forming the rigid, strong container.

The skids 11 make it possible for the container 1 to be winched onto and off of a trailer without the need for cranes or forklifts. However, for maximum flexibility of use, appropriately spaced and sized, forklift tine cutouts or slots 11A are provided in each skid.

Again with reference primarily to FIG. 1, the equipment end 2 of the container 1 includes all of the operative equipment, including the cooler or freezer unit 14, including a compressor and a diesel fueled motor, located in the top of the equipment end section 2, preferably with an oil drip or catch pan 15 located right below it. Below that, located to one side are the waste oil collector tank 16 and the fuel tank 17 in an isolated compartment. To the other side in another isolated area are the system control panel 18, an emergency stop actuator or button 19 and a fire extinguisher 20 located at the bottom. The area 22A behind the door 22 also includes sufficient, supplemental storage area for, for example, oil (stored in sealed containers, e.g., unopened cans), fuel filters, belts and other maintenance items.

In the preferred exemplary embodiment there also is an optional, fuel level alarm light 28 that turns "on"(i.e. is lighted as, for example, a brightly blinking light) when the fuel level gets low. It is preferably located on the exterior of the end wall of the equipment section 2, with the end tips of the skids 11 extending out in front of the container end, providing protection to the alarm light. This level alarm, for example, also can be run to a remote location by, for example, through over-the-air communication or by telephone line link or computer network link, for added convenience in monitoring the fuel supply condition of the refrigerated containers 1 of the present invention.

As can be seen in comparing FIGS. 1F & 1E and again with reference to FIG. 1, all of this equipment is fully enclosed and housed in isolated sections or sub-compartments in the end section 2, with doors or panel covers being used for access to the equipment. Thus, none of the operating equipment is directly exposed to the surroundings, and all the equipment is contained within the strong, basic beam structural framework, including the two, end, corner beams 12, the end portions of the longitudinal, side beams 13 and the end, upper & lower, lateral beam 13A, and is very protected as the container 1 is transported or otherwise moved about. As seen in FIG. 1E, access doors or panel covers are provided for easy but protected access to the equipment, including door 21 (covering over the sub-compartment 21A) for the isolated tanks 16 & 17, door 22 (covering over the sub-compartment 22A) for the control panel 18, the emergency button 19 (accessible from the outside of the door 5, i.e., from the exterior) and fire extinguisher 20, side, flanking panel doors 23 & 24 for access to the sides of the cooler/freezer unit 14, along with top door 25 (note 5 FIG. 1C).

The central area 26 between the two, upper side doors 23 & 24 are lourved or slatted and, additionally, each side of the container 1 at the upper part of its equipment end 2 includes an additional lourved or slatted panel 26A/26B. This allows for the free flow of air to, from and around the cooler/freezer unit 14, while still providing a protective environment. The upper section of the equipment section end wall, including the side panel doors 24A & 24B and the central, lourved area 26 are integrated together into a common panel 24–26 (note FIGS. 1A & 1E), which can be pulled down about bottom hinges with a chain 29 to limit its downward movement. Alternatively, the overall, upper panel section 24–26 can be screw mounted to the container frame and/or housing, so that it can be easily removed (for open access to the area occupied by the compressor/motor 14 and its removal, if necessary) and replaced with the use of the screws, with the chain then serving as a safety device to prevent the panel's loss should it come loose during transit.

The control panel 18 includes circuitry, temperature sensor readers, and actuators, switches, etc., well know to those of ordinary skill and available "off-the-shelf," for turning the motor driven compressor (14) "on" and "off" and to set the lowered temperature to be created and maintained within the storage compartment 3, and to automatically switch between diesel power to electrical power when electrical power is available at the destination site. The compressor-motor unit 14 can be, for example, a "Carrier™"(Syracuse, N.Y., a United Technologies Corporation) Model Supra 744, or a "Thermo King™"(Thermo King Corp. of Minneapolis, Minn., Ingersoll-Rand Company) Model MD-11SR.

The compressor-motor(s) unit 14 includes an evaporator 14A (note FIG. 1D) which extends into the refrigerated storage compartment 3 to cool it. The evaporator 14A includes the compressor's evaporator coil, fan(s), temperature sensor(s), etc., and produces the cooling air into the storage compartment. When being installed in the container structure, the compressor-motor unit 14 is inserted into the subcompartment 26C, with the evaporator section 14A being inserted into and through the rectangular opening 26D (note FIG. 1).

As the liquid fuel (preferably diesel) powered, compressor motor operates, some oil, lubricants or like waste will be generated or produced, which falls or drips into the oil pan 15. A drain line 15–16 (generally depicted as a dashed line in FIG. 1) extends from the outlet 15A to the inlet 16A of the waste oil tank 16. The fuel tank 17, capable of holding several operating days (e.g. 100–200 U.S. gallons) of diesel fuel, has a normally closed fuel-filling fitting 17A. Below both the waste tank 16 and the fuel tank 17 is a catch pan for catching and collecting any spilled waste or fuel.

Both the waste oil tank 16 and the fuel tank 17 have vent fittings 16B & 17B, respectively, which vent the tanks via, for example, lines 16–27 and 17–27, out to the side breather vents 27 (note FIGS. 1 & 1A). The tank vent lines 16–27 and 17–27 preferably include flame arresters and ball-check valves or other appropriate valving.

Also, spark arresters are included on the refrigeration compressor's muffler system, and engine over-speed protection is provided, particularly for the placement of the container 1 in an area where, for example, natural gas is or may be present.

In addition to the diesel fuel motor, the equipment end 2 also preferably includes an electric motor (e.g., using 208–480, three phase power) attached to the compressor for alternatively driving the compressor, so that the system can work off either diesel fuel or electrical power, depending on which power source is more relatively available. The system is typically set up at the control panel 18 so that the diesel powered compressor will be switched over automatically to the electric motor when electrical power is available and its presence sensed by the system. Then should the electrical power fail, the system switches back over to diesel power, and so on. This available duality greatly adds to the security and reliability of the refrigeration of the present invention.

In general, the exterior fabrication of the container 1 can be welded steel, aluminum, galvanized steel or stainless steel, with the construction preferably being done by ABS certified welders. Covering over the structural framework of the structural beams (12, 13, 13A) are sheets of metal affixedly fastened to the framework, preferably with spaced, vertically disposed, "V" shaped crimps along, the length of the container 1 for enhanced structural wall strength (note FIGS. 1A & 1B).

The containers are provided in appropriate lengths, for example, the forty (40') foot model illustrated in FIGS. 1+, supplemented by, for example, twelve (12') and twenty (20') foot lengths. Each of the embodiments can have the same basic cross-section, namely, a vertical height of about eight (~8') feet above the skids 11 and a lateral width of about eight and a half (~8.5') feet. With such dimensions and the greater length of the storage compartment 3 in comparison to the equipment section 2, it should be clear that the storage compartment 3 can contain relatively large quantities of temperature sensitive items.

The preferred, exemplary twelve (12'), twenty (20') and forty (40') foot containers (1) can alternatively be divided into two compartments, as illustrated in FIGS. 2A–2D, namely, a container 101 having a freezer 103A on one side and a cooler 103B on the other, with separate doors 105A & 105B, respectively, into each. Also, as an alternative, it is noted that the single storage units 1 can range from a deep freezer to a cooler by appropriately setting the temperature controller (18) for alternative, dual use, while the second embodiment allows for concurrent, dual use. It is noted that the embodiments of FIGS. 1+ and 2A–2D are very similar, with the primary difference being the storage compartment 103 is divided into the two sub-sections 103A (freezer) & 103B (cooler) and with the two, separate doors 105A & 105B, preferably positioned adjacent to one another on opposite sides of the insulated, dividing wall 103C and being positioned on the side of the container 101.

Figure 1D:
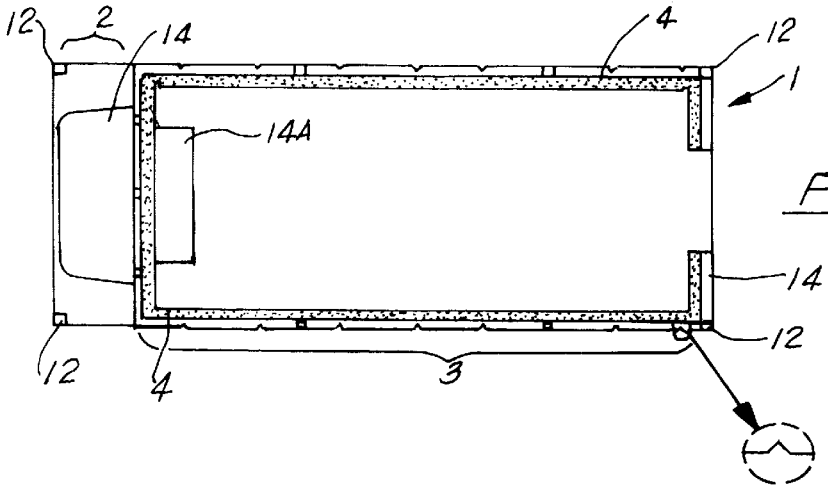
FIGS. 1C & 1D are plan views taken of the top and then down below at the level of the interior, respectively, with FIG. 1D taken down at the location of section lines 1D–1D of FIGS. 1A & 1B, of the container of FIG. 1.
Figure 1C:
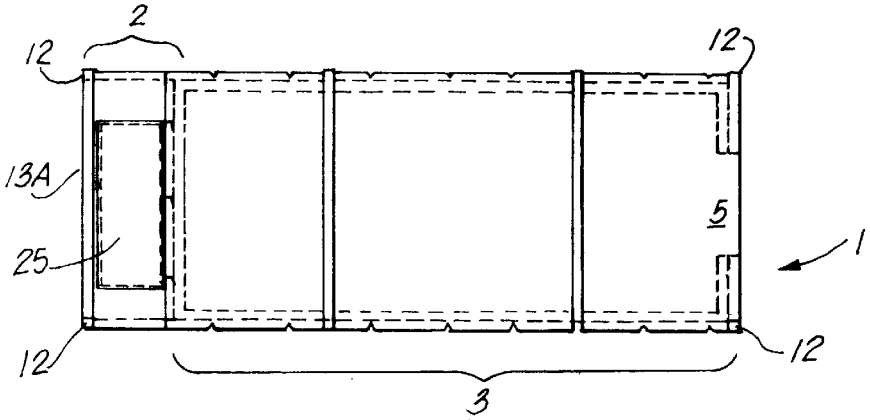
Figure 1E:
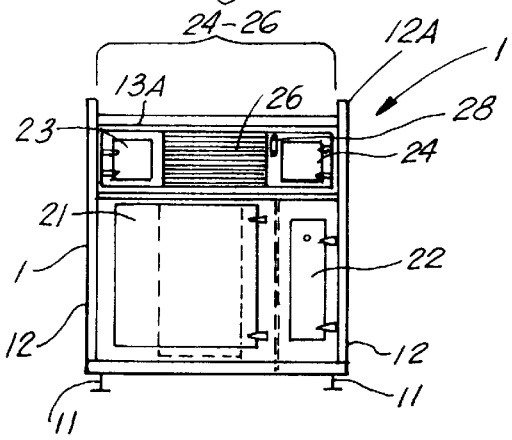
Figure 2A:
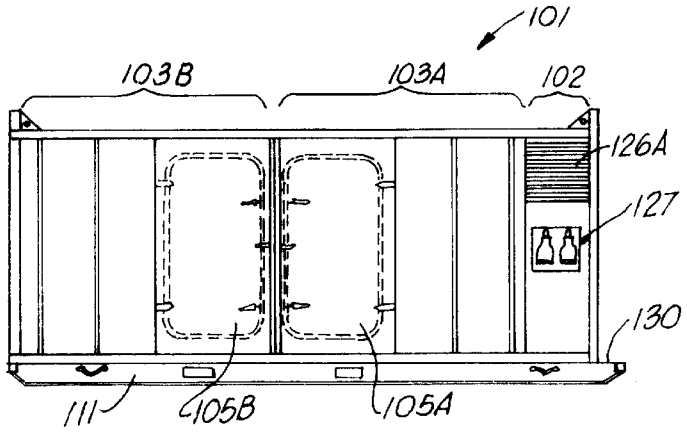
FIGS. 2A & 2B are right and left, side views, respectively, of a second embodiment of the container of the transportable, self-contained refrigeration system of the present invention, with this container embodiment having both cooler and freezer sub-sections.
Figure 2B:
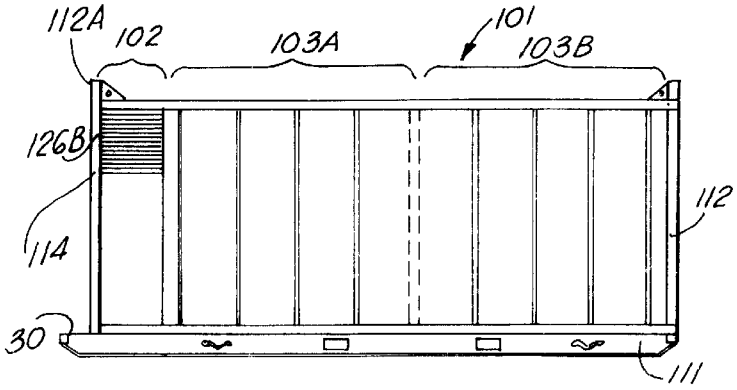
Figure 2C:
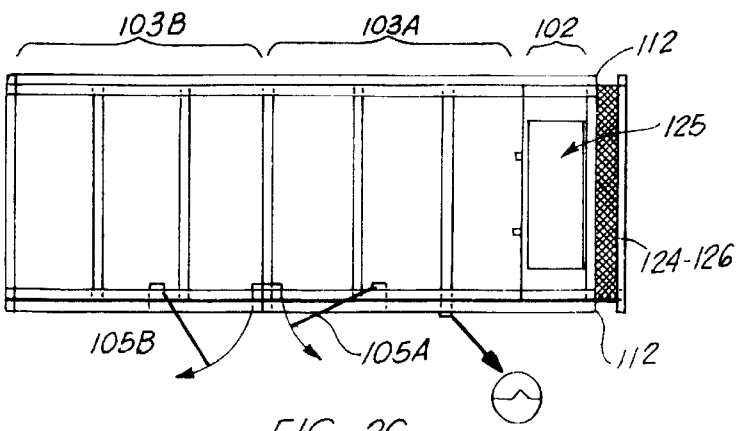
FIGS. 2C & 2D are plan views taken of the top and then down in the level of the interior, respectively, with FIG. 2D taken at the location of section lines 2D—2D of FIGS. 2A & 2B, of the second exemplary embodiment of the container.
Figure 2D:
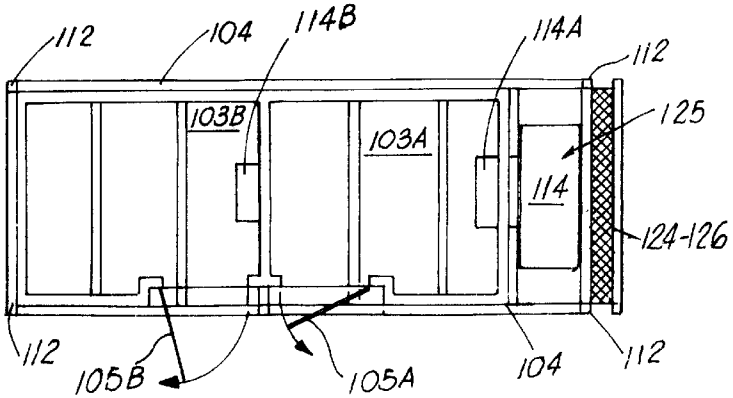

To separately handle the lowered temperature levels of the freezer 103A and the cooler 103B, two evaporator sections 114A & 114B are provided, one leading in to the freezer and the other leading into the cooler, with the freezer evaporator section 114A situated in similar fashion to the location of the evaporator section 14A positioned in the refrigerated storage compartment 3 of the first embodiment (note FIGS. 1 & 1D). The cooler evaporator 114B is connected to the compressor 114 by extended copper lines mounted to and extending along the ceiling of the freezer compartment 103A until they reach the second evaporator 114B located at the dividing wall 103C between the freezer and the cooler compartments 103A/103B.

Likewise, analogous reference numbering has been used in the drawings, with the numbering for the analogous or exact structure of the second embodiment being the same as the first embodiment but with a hundred being added to the reference numbers of the first embodiment. Thus, for the sake of brevity, only the major differences between the two, exemplary embodiments have been discussed here.

It should be understood that in using herein the terms "horizontal" or "vertical," such is being used in a relative sense and not necessarily literally. Thus, for example, those terms would be literal when the bottom of the container is sitting on a flat, horizontal surface but relative when the container 1 is set at an angle to the true horizontal. Additionally, the terms "door" and "panel" are considered equivalent terms in the context of the door/panels used on the exterior, end wall of the equipment section 2.

Distribution of Food to, e.g., Oil Platforms

In accordance with the preferred embodiment of the present invention and with general reference to FIG. 4, the food and/or other temperature sensitive materials are loaded into the storage compartment 2 of the container 1 at the food distribution center. The container 1 preferably runs on diesel power and is set to the appropriate temperature using the control panel 18 for the type of food or other temperature sensitive material loaded inside.

The loaded container 1 thereafter is delivered to the port, unloaded, then sent offshore on, for example, a supply vessel. The container preferably is not opened until after it arrives at its final destination. Thus, foods can be loaded at the market and not opened again until it has reached the manned, offshore platform. This eliminates any excessive variations in the controlled temperature of the food products.

In contrast to the prior art in-route, shipping delays are not a problem, because the exemplary container unit 1 runs for, for example, seven to fourteen (7–14) days without needing refueling and can be easily refueled along its route or even at its destination, if so desired. Additionally, the container 1 can also be used for short and long term storage on the offshore platform of its destination by means of diesel or electrical power, eliminating the need for as-frequent grocery runs from the shore to the offshore platform.

Additionally, the preferred container design meets all known, current offshore material requirements. Some of these preferred features of the preferred container 1 include the following:

- spark arresters are included on the refrigeration compressor's muffler system;
- a waste oil tank 16, preferably located adjacent to the fuel tank 17, is provided to ultimately capture and collect any leakage from the compressor's motor section, with both of them located in a physically isolated sub-compartment 21A within the confines of the equipment section 2;
- a fire extinguisher 20 is located in the rear, equipment section compartment 2 of the container 1 adjacent to where any fire might occur;
- the diesel fuel tank 17 and the waste tank 16 are physical isolated in their sub-compartment 21A from the container's electrical components (18), which components, for example, might spark;
- an emergency engine shut-down button 19 is provided for quick and easy shut-down of the compressor's motor, as well as preferably all other equipment (fuel pumps, etc.) serving as a total shut-down of the system;

engine over-speed protection is provided, particularly for the placement of the container 1 in an area where, for example, natural gas is or may be present;

an emergency lock-in handle (9) for the door(s) 5 into the food compartment 3 of the container 1, designed to release the locked latch from the exterior wall 10, is included in case someone gets locked-in in the refrigerated "food" storage compartment 3;

the container 1 is mounted on skids 11, allowing for relatively easy movement of the container, for example, off and/or on a trailer truck or along a platform surface, with the same skid structure having spaced slots 11A in its sides providing a strong interface for the fork tines of a fork lift truck for further ease in moving the container around a site; and the container 1 is of all steel construction, with provisions for attaching a hoist using sling connection holes 12C at or adjacent to its four corners (12A) for being lifted by a crane; etc.

The container preferably is built to American Bureau of Shipping Standards (ABSS) and Board of Health approval. Additionally, the container 1 preferably meets OHSA and Jones Act standards and requirements. The preferred embodiments of the container of the present invention are believed to be the first to achieve all of these desirata in a cost effective manner.

Of course, the delivery of food to an offshore platform is a particularly efficacious application, other examples include seismic and research vessel food containment, in which, for example, some of the vessels operate in foreign regions where food is not accessible for a long period of time. For further example, one or more of the containers 1 could be loaded aboard such vessels before departing overseas, with the container(s) being stocked with frozen foods, transported, then unloaded at, for example, a work site port as a temporary deep freeze facility.

FEMA Emergency/Disaster Operations

The preferred container is also useful for FEMA type or other emergency or disaster operations and applications and reference is generally had to FIG. 5.

In contrast to the prior art the preferred container embodiments of the invention burn much less fuel, since it only burns fuel when the unit turns "on" to maintain the pre-set, lowered temperature. Additionally, it can be easily winched on and off a truck on its skids 11 and/or picked up by a crane in its transportation to and around an emergency or disaster site. The fork tines slots 11A in the base skid structure 11 of the container 1 can likewise be used for moving the container around a site using a fork lift truck.

Likewise, the preferred container 1 of the invention can be deployed by parachute from a plane. The rigid, high-strength construction of the container 1 can withstand a hard fall. If weight is a problem or a serious consideration, the preferred container 1 preferably is constructed from aluminum, rather than steel. The container's skids 11 allow it to be relatively easily dragged, pushed or pulled over the ground using, for example, a winch. It's water tight construction also allows it to float in water. In, for example, a desert type environment with its sand storms, appropriate, slide-in sand filters well known in the art can replace or be placed over the louvered panels 26, 26A & 26B to resist any sand incursion into the operating equipment, including in particular the refrigeration compressor and motor (14) and prevent or retard any choking of the compressor coils.

If a disaster arises (e.g., a hurricane, earthquake, tornado, flood, bombing, etc.), for example, three of the twelve (12') foot refrigerated container units can be delivered, loaded on, for example, one eighteen (18) wheeler truck, delivered to the site, then used, for example, as temporary storage of ice, food, medical supplies, etc., or even as a temporary morgue.

The preferred embodiments of the invention are useful, for example, in countries where disasters strike relatively often, and loss of electrical power is relatively common. The container of the invention can be, for example, connected to "city" power. When power is lost, the preferred container automatically switches to the self-contained container's internal diesel power.

It is noted that the embodiments described herein in detail for exemplary purposes are of course subject to many different variations in structure, design, application and methodology. Because many varying and different embodiments may be made within the, scope of the inventive concepts herein taught, and because many modifications may be made in the embodiments herein detailed in accordance with the descriptive requirements of the law, it is to be understood that the details herein are to be interpreted as illustrative and not in a limiting sense.

What is claimed is:

1. A transportable, self-contained refrigeration system, comprising:

a transportable container having a structural framework including at least four, vertically and laterally spaced, longitudinally extending, horizontally disposed, side, structural beams, four, longitudinally and laterally spaced, vertically disposed, corner, end beams, and four, vertically and longitudinally spaced, laterally extending, horizontally disposed, end beams, all of said beams being fixedly joined together at at least near their ends forming a rigid, structurally strong framework defining an extended, box-like configuration having two ends, said container having in its interior at least two sections an enclosed, equipment section located at one end of said framework completely within said box-like configuration and being substantially enclosed by walls with associated access door panels allowing access into said equipment section, and at least one, refrigerated, storage compartment section longer than said equipment section located at the other end completely within said box-like configuration, said refrigerated storage section including at least one access door into it of a size allowing a person to walk through, but being, otherwise enclosed, said refrigerated storage section being insulated providing an insulated interior having the capability to house, at a substantially lower temperature than the ambient, temperature sensitive materials, including at least one item from the group consisting of food stuffs, medical supplies, ice and human corpses;

said equipment section including within its confines at least the following equipment a refrigeration producing compressor associated with said refrigerated storage compartment to cool its interior, at least one combustible liquid fuel powered motor mechanically interconnected to said compressor to drive it, a combustible liquid fuel tank for supplying liquid fuel to said motor, and control mechanisms associated with said compressor and motor for controlling the motor driven compressor to control the motor to at least turn it "on" and "off" in response to the temperature level sensed in said interior of said storage compartment, all of said equipment being, physically protected by said structural framework located round said equipment section and by said walls and associated access door panels.

2. The transportable refrigeration system of claim 1, wherein:

said control mechanisms are at least in part electrical in nature and capable of producing sparks; and wherein:

said combustible liquid fuel tank and said motor are housed in physical isolation from said control mechanisms, using interior walls within said equipment section creating at least one sub-compartment, preventing any spark generated in said electrical control mechanisms from igniting any combustible liquid fuel or fumes therefrom from being ignited.

3. The transportable refrigeration system of claim 2, wherein:

said equipment section further includes within its confines a laterally extended, liquid drip pan located directly below said compressor and said motor, catching any liquids that fall or drip down from either of them; and wherein there is further included within said confines of said equipment section:

a waste tank located below and being associated with said drip pan serving to collect the liquid waste from said drip pan.

4. The transportable refrigeration system of claim 3, wherein:

said waste tank is located adjacent to said fuel tank in the same subcompartment and is also physically isolated from said electrical control mechanisms preventing any exposure to sparks from the electrical control mechanisms.

5. The transportable refrigeration system of claim 1, wherein:

said motor has a muffler, and wherein there is further included:

a spark arrester on said muffler.

6. The transportable refrigeration system of claim 1, wherein there is further included:

a pair of skids mounted on the bottom of said enclosed container, located adjacent to but spaced laterally inwardly from said side, structural beams and extending past them at both ends, providing a footing, step area of a size sufficient for a person to stand on.

7. The transportable refrigeration system of claim 6, wherein:

said four, corner, end beams extend up above their connections with said side beams and said end beams; and wherein:

there are included at least two of said containers, one mounted on top of the other, with said skids of the top container being located in board of said four corner beams of the container immediately beneath it, preventing said top container from slipping off the sides of the container immediately beneath it.

8. The transportable refrigeration system of claim 1, wherein:

said motor is a diesel motor and said fuel tank is a diesel fuel.

9. The transportable refrigeration system of claim 1, wherein there is further included within the confines of said equipment section:

an electrical motor located adjacent to said refrigeration compressor mechanically interconnected to said refrigeration compressor to alternatively drive said compressor as an alternative to said liquid fuel motor.

10. The transportable refrigeration system of claim 1, wherein:

said fuel tank includes a sufficient amount of liquid fuel for said liquid powered motor to drive the compressor for an extended period of time of at least about seven (7) days.

11. The transportable refrigeration system of claim 1, wherein there is further included:

a fire extinguisher Located within said confines of said equipment section, thereby being adjacent to where any fire might occur.

12. The transportable refrigeration system of claim 1, wherein there is further included:

an emergency engine shut-down system all of which is located within the confines of said equipment section, except for an actuator located on the wall of said equipment section, useable by a person from outside said container to shut the system down, providing quick and easy shut-down of the compressor's motor, as well as all other operating equipment, thereby serving as a total shut-down of the system.

13. The transportable refrigeration system of claim 1, wherein there is further included:

an engine over-speed protection sub-system located in the confines of said equipment section and connected to said motor, preventing the motor from rotating at an RPM in excess of a pre-selected level.

14. The transportable refrigeration system of claim 1, wherein there is further included:

an emergency lock-in prevention sub-system, actuateable from within said storage compartment, allowing the release of said door even when it is locked for use in case someone gets locked into said storage compartment.

15. The transportable refrigeration system of claim 1, wherein there is further included:

a pair of skids mounted on the bottom of said enclosed container, located adjacent to but spaced laterally inwardly from said side, structural beams, each of said skids having longitudinally spaced slots in its sides providing a strong interface for the fork tines of a fork lift truck for further ease in moving said container around a site.

16. The transportable refrigeration system of claim 1, wherein there is further included:

sling connection plates with holes therein located at least in juxtaposition to the tops of said four, corner beams, allowing easy connection for lifting said container by a crane.

17. A system for transporting a container for relatively large quantities of temperature sensitive items to a site far removed from the location of the container, comprising the use of:

a transportable container having a structural framework including at least four, vertically and laterally spaced, longitudinally extending, horizontally disposed, side, structural beams, four, longitudinally and laterally spaced, vertically disposed, corner, end, structural beams, and four, vertically and longitudinally spaced, laterally extending, horizontally disposed, end, structural beams, all of said structural beams being fixedly joined together at at least near their ends forming a rigid, structurally strong framework defining an extended, box-like configuration having two ends, said container having in its interior at least two sections an enclosed, equipment section located at one end of said framework completely within said box-like configuration and being substantially enclosed by walls with associated access door panels allowing access into said equipment section, and at least one, refrigerated, storage compartment section longer than said equipment section located at the other end completely within said box-like configuration, said refrigerated storage section including at least one access door into it of a size allowing a person to walk through, but being otherwise enclosed, said refrigerated storage section being insulated providing an insulated interior having the capability to house, at a substantially lower temperature than the ambient, temperature sensitive materials, including at least one item from the group consisting of food stuffs, medical supplies, ice and human corpses;

said equipment section including within its confines at least the following equipment a refrigeration producing compressor associated with said refrigerated storage compartment to cool its interior, at least one combustible liquid fuel powered motor mechanically interconnected to said compressor to drive it, a combustible liquid fuel tank for supplying liquid fuel to said motor, and control mechanisms associated with said compressor and motor for controlling the motor driven compressor to control the motor to at least turn it "on" and "off" in response to the temperature level sensed in said interior of said storage compartment, all of said equipment being physically protected by said structural framework located round said equipment section and by said walls and associated access door panels;

and the methodology comprising the steps of:

transporting the container to the far removed site.

18. The system of claim 17, wherein said beginning location is an onshore food distribution center, said far removed site is an offshore platform and said temperature sensitive items are food stuff items needed at the offshore platform; and wherein there is further included the steps of:

a) loading the food stuff items into said refrigerated, storage compartment;

b) in association with the step of loading, in step "a," starting said motor driving, said compressor and cooling said interior of said storage compartment; and c) transporting the loaded container over land and over water to said offshore platform, while said access door(s) are continuously maintained closed until after arriving at said offshore platform.

19. The system of claim 18, wherein there is further included within the confines of said equipment section of said container:

a n electrical motor located adjacent to said refrigeration compressor mechanically interconnected to said refrigeration compressor to alternatively drive said compressor as an alternative to said liquid fuel motor, and wherein there is included the further step of:

after said container reaches said far removed site, using electrical power available at said far removed site to power said electrical motor to run said compressor.

20. The system of claim 17, wherein said far removed site is the site of a disaster and said temperature sensitive items are needed at the site of the disaster, and wherein there is further included the steps of:

a) loading the items into said refrigerated, storage compartment;

b) in association with the step of loading in step "a," starting said motor driving said compressor and cooling said interior of said storage compartment; and c) transporting the loaded container to said disaster site, while said access door(s) are continuously maintained closed until after arriving at said disaster site.

21. The system of claim 20, wherein there is further included the step of:

after reaching the disaster site, unloading at least most of the items loaded in step "a;" and then loading human corpses into the storage compartment and maintaining an appropriately lowered temperature in said storage compartment using said motor.

22. The system of claim 17, wherein there is further included:

one or more of the other "unobvious" innovations disclosed in the foregoing specification.

* * * * *